US006139344A

United States Patent [19]

Wang

[11] Patent Number: 6,139,344

[45] Date of Patent: Oct. 31, 2000

[54] COAXIAL CABLE CONNECTOR WITH SIGNAL PATH SWITCHING ARRANGEMENT

[76] Inventor: Tsan-Chi Wang, 4th Floor, No. 8, Alley 8, Lane Ssu-Wei, Chung Cheng Rd., Hsin-Tien City, Taipei Hsien, Taiwan

[21] Appl. No.: 09/379,118

[22] Filed: Aug. 23, 1999

[30] Foreign Application Priority Data

Mar. 31, 1999 [TW] Taiwan ..... 88204947

[51] Int. Cl.[7] ..... H01R 29/00

[52] U.S. Cl. ..... 439/188; 439/944; 200/51.1

[58] Field of Search ..... 439/188, 944, 439/578; 200/51.1

[56] References Cited

U.S. PATENT DOCUMENTS 3,946,390 3/1976 Alexander et al. ..... 343/702

5,112,237 5/1992 Yang ..... 439/188

5,836,776 11/1998 Koch ..... 439/188

5,921,793 7/1999 Phillips ..... 439/188

*Primary Examiner*—Khiem Nguyen

*Assistant Examiner*—Brian S. Webb

*Attorney, Agent, or Firm*—Pollock, Vande Sande & Amernick

[57] ABSTRACT

A coaxial cable connector, which includes a hollow metal casing, an insulator set, and an electrically conductive signal terminal mounted within the casing and insulated from the casing by the insulator set, wherein when a matching coaxial cable connector is installed, the signal terminal is set into a first form for external signal transmission; when the matching coaxial cable connector is disconnected, the signal terminal is set into a second form for internal signal transmission.

7 Claims, 9 Drawing Sheets

COAXIAL CABLE CONNECTOR WITH SIGNAL PATH SWITCHING ARRANGEMENT

BACKGROUND OF THE INVENTION

The present invention relates to a coaxial cable connector, and more particularly to such a coaxial cable connector which can be selectively switched between two signal transmission paths.

A coaxial cable connector provides no function for signal transmission when the matching coaxial cable connector is disconnected, and it provides a signal path for signal transmission only after the installation of the matching coaxial cable connector. Because a coaxial cable connector provides only one signal transmission path, it cannot fit certain equipment which requires two selective signal paths. For example, when a mobile telephone is carried by the user, it receives radio signal directly by its antenna. However, when used in a car, the antenna of the mobile telephone may be unable to receive radio signal well. In this case, the antenna of the mobile telephone may have to be directly connected to the receiving antenna of the car so that the mobile telephone can achieve satisfactory signal receiving during running of the car.

SUMMARY OF THE INVENTION

It is the main object of the present invention to provide a coaxial cable connector which can be selectively switched between two signal transmission paths.

A coaxial cable connector according to the present invention is comprised of a casing, insulator means, and a signal terminal set.

The casing is a hollow cylindrical shell for holding the insulator set and the signal terminal set. The front end of the casing is designed to receive a matching coaxial cable connector. The rear end of the casing is provided with a plurality of mounting legs for fastening to a printed circuit board.

The insulator means can be comprised of a single piece insulator or multiple insulators installed in the casing to isolate the signal terminal set from the casing.

The signal terminal set is mounted inside the casing and insulated by the insulator means, and comprised of a first terminal and a second terminal. The first terminal and the second terminal are electrically connected before the installation of the matching coaxial cable connector for internal signal transmission. When the matching coaxial cable connector is installed, the first terminal and the second terminal are separated from each other, and external signal is allowed to be transmitted through the coaxial cable connector.

DETAILED DESCRIPTION OF THE PREFERRED EMBODIMENT

Figure 1:
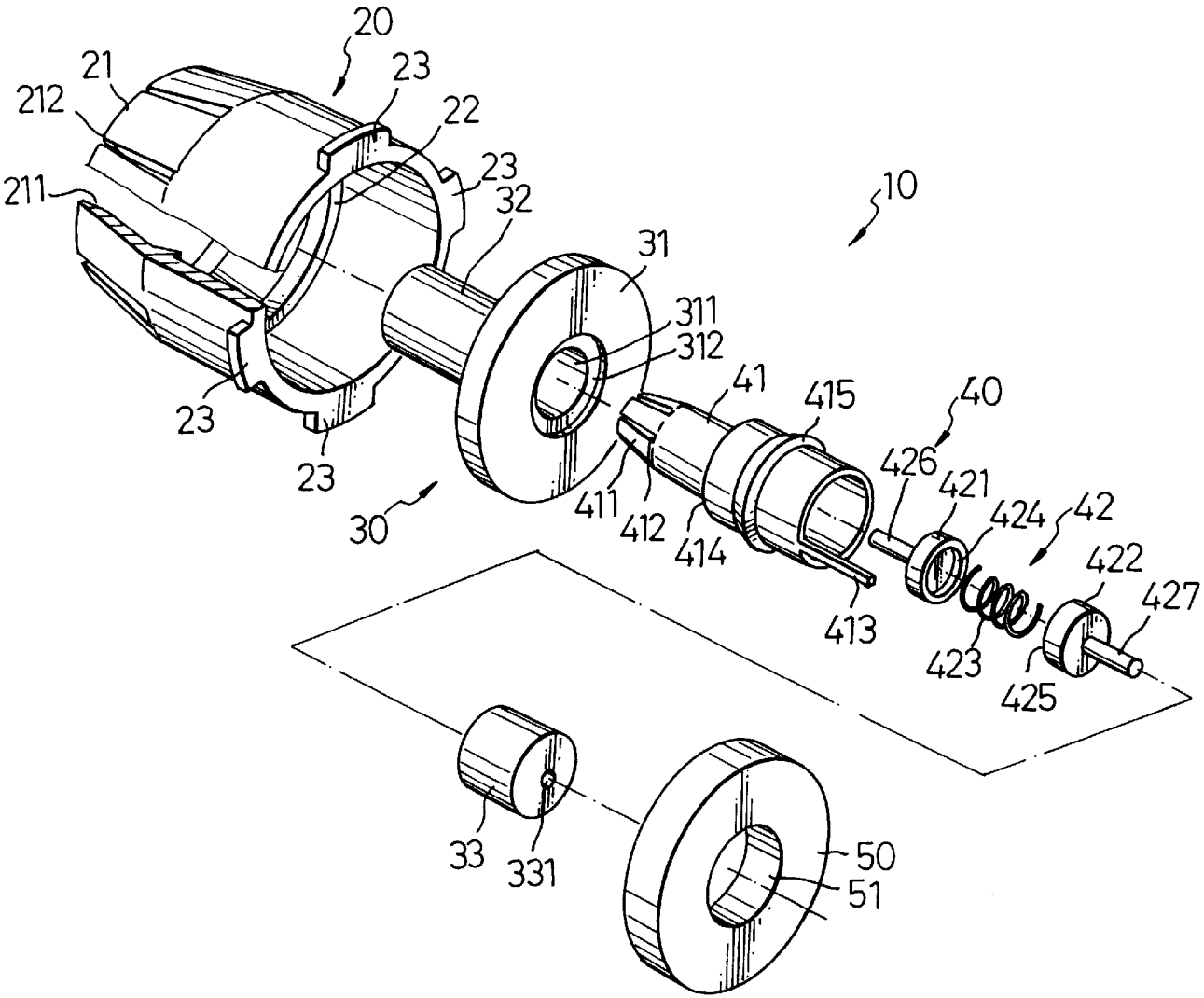
FIG. 1 is an exploded view of a coaxial cable connector according to one embodiment of the present invention.

Referring to FIGS. from 1 through 3 a coaxial cable connector 10 according to one embodiment of the present invention is shown comprised of a casing 20, an insulator set 30, a signal terminal set 40, and a positioning member 50.

The casing 20 is a hollow cylindrical metal shell for grounding. When in use, the casing 20 is connected to a matching coaxial cable connector 80. The casing 20 comprises a plurality of clamping strips 21 and longitudinal slots 212 alternatively arranged around the periphery at its one end. After insertion of the matching coaxial cable connector 80 into the casing 20, the clamping strips 21 are pressed on the outside wall of the matching coaxial cable connector 80, thereby causing the coaxial cable connectors 10 and 80 to be firmly retained together. Further, a beveled guide edge 211 is provided at one end of the casing 20 for guiding the matching coaxial cable connector 80 into position.

The casing 20 further comprises stop means 22 raised from its inside wall for the positioning of the insulator 30. The stop means 22 can be made in any of a variety of forms, for example, it can be an inside annular flange raised around the inside wall of the casing 20, or a plurality of blocks equiangularly spaced around the inside wall of the casing 20.

Further, four mounting legs 23 are equiangularly raised around the periphery of the casing 20 at one end remote from the clamping strips 21. The mounting legs 23 are provided for two purposes, one is for securing the coaxial cable connector 10 to a PC (printed circuit) board 90, and the other is for grounding. According to the present embodiment, the mounting legs 23 have a flat shape for surface-mounting on the PC board positively.

The insulator set 30 comprises a first insulator 31, and a second insulator 33.

The first insulator 31 is a circular member mounted within the casing 20 and supported on the stop means 22, having a center hole 311, a tubular extension 32 raised from a front side thereof around the center hole 311, and an annular groove 312 formed at a back side thereof around the center hole 311.

The second insulator 33 is a hollow cylindrical member having a center hole 331 at the center of the bottom side thereof.

The signal terminal set 40 is a comprised of a first terminal 41, and a second terminal 42. The first terminal 41 and the second terminal 42 are respectively made of electrically conductive material.

The first terminal 41 is a stepped, hollow cylindrical member comprising a plurality of clamping strips 411 and longitudinal slots 412 alternatively arranged around the periphery at its one end (namely, the front end) for securing a corresponding part of the matching coaxial cable connector 80, a leg 413 at its opposite end (namely, the rear end) for fastening to the PC board 90, a shoulder 414 on the middle stopped at the annular groove 312 at the first insulator 31, and a locating flange 415 raised around the periphery and spaced between the shoulder 414 and the leg 413 for the positioning of the positioning member 50.

The second terminal 42 is mounted in the first terminal 41, comprised of a front terminal element 421, a rear terminal element 422, and a metal spring element 423. The front terminal element 421 and the rear terminal element 422 are symmetrical, each comprising a base 424 or 425, and a cylindrical projection 426 or 427 raised from the base 424 or 425. The cylindrical projection 427 of the rear terminal element 422 is inserted through the center hole 331 at the second insulator 33, and then connected to the PC board 90. The spring element 423 is connected between the base 424 of the front terminal element 421 and the base 425 of the rear terminal element 422.

The positioning member 50 is made of electrically insulate material, having a profile fitting the inside wall of the casing 20. The outer diameter of the positioning member 50 is approximately equal to the inner diameter of the rear end (the end remote from the clamping strips 21) of the casing 20, therefore the positioning member 50 can be press-fitted into the rear end of the casing 20. The positioning member 50 has a center through hole 51, which receives the rear end of the first terminal 41, enabling the locating flange 415 of the first terminal 41 to be stopped at one side of the positioning member 50.

The assembly process of the coaxial cable connector 10 is outlined hereinafter with reference to FIGS. from 1 through 3 again.

The first insulator 31 is inserted into the casing 20 and stopped at the stop means 22. The outer diameter of the first insulator 31 is approximately equal to or slightly greater than the inner diameter of the casing 20, so that the first insulator 31 can be press-fitted into the casing 20.

After installation of the first insulator 31 in the casing 20, the first terminal 41 is inserted into the center hole 311 at the first insulator 31, enabling the shoulder 414 to be engaged into the annular groove 312 at the first insulator 31.

Thereafter, the second terminal 42 and the second insulator 33 are respectively mounted in the first terminal 41, and then the positioning member 50 is press-fitted into the casing 20 to hold down the first terminal 41 in position.

Figure 3:
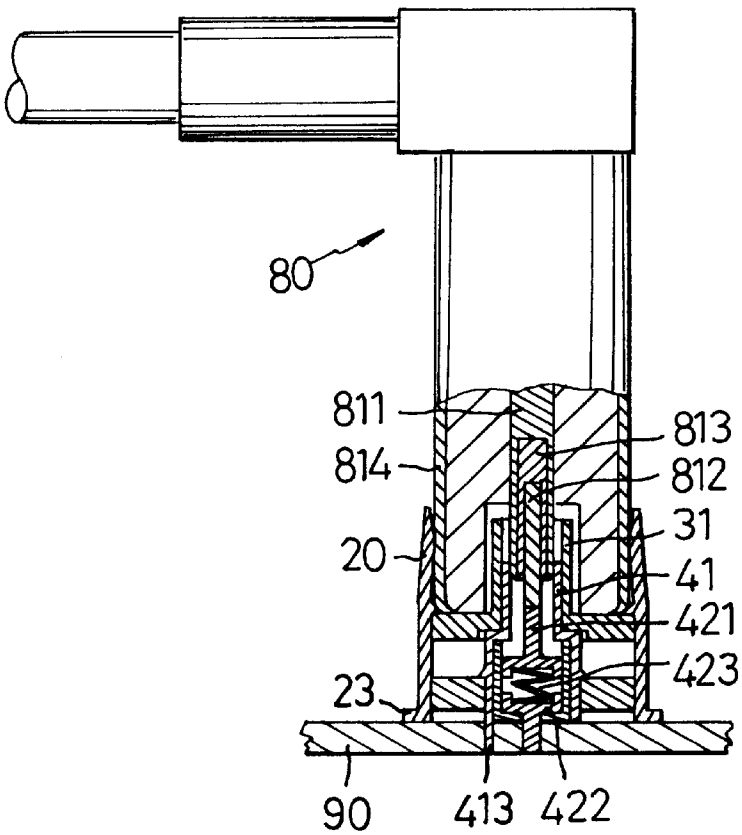
FIG. 3 is similar to FIG. 2 but showing the matching coaxial cable connector connected to the coaxial cable connector of the embodiment shown in FIG. 1, the second signal path electrically connected.
Figure 2:
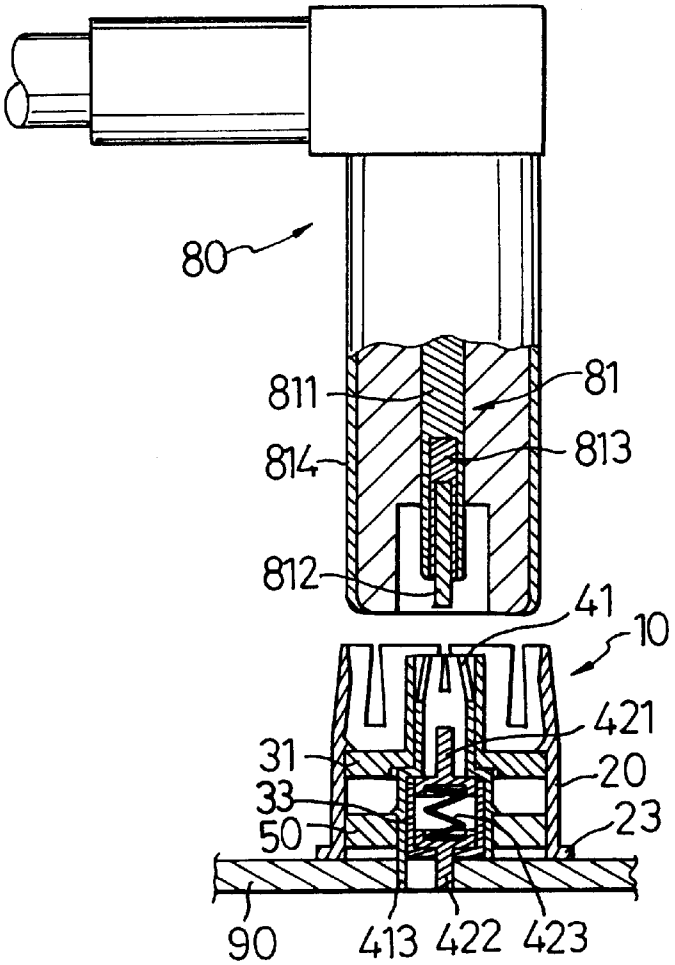
FIG. 2 illustrates the relationship between the coaxial cable connector of the embodiment shown in FIG. 1 and the matching coaxial cable connector, the coaxial cable connector of the embodiment shown FIG. 1 installed in the PC board, the first signal path electrically connected.
Figure 4:
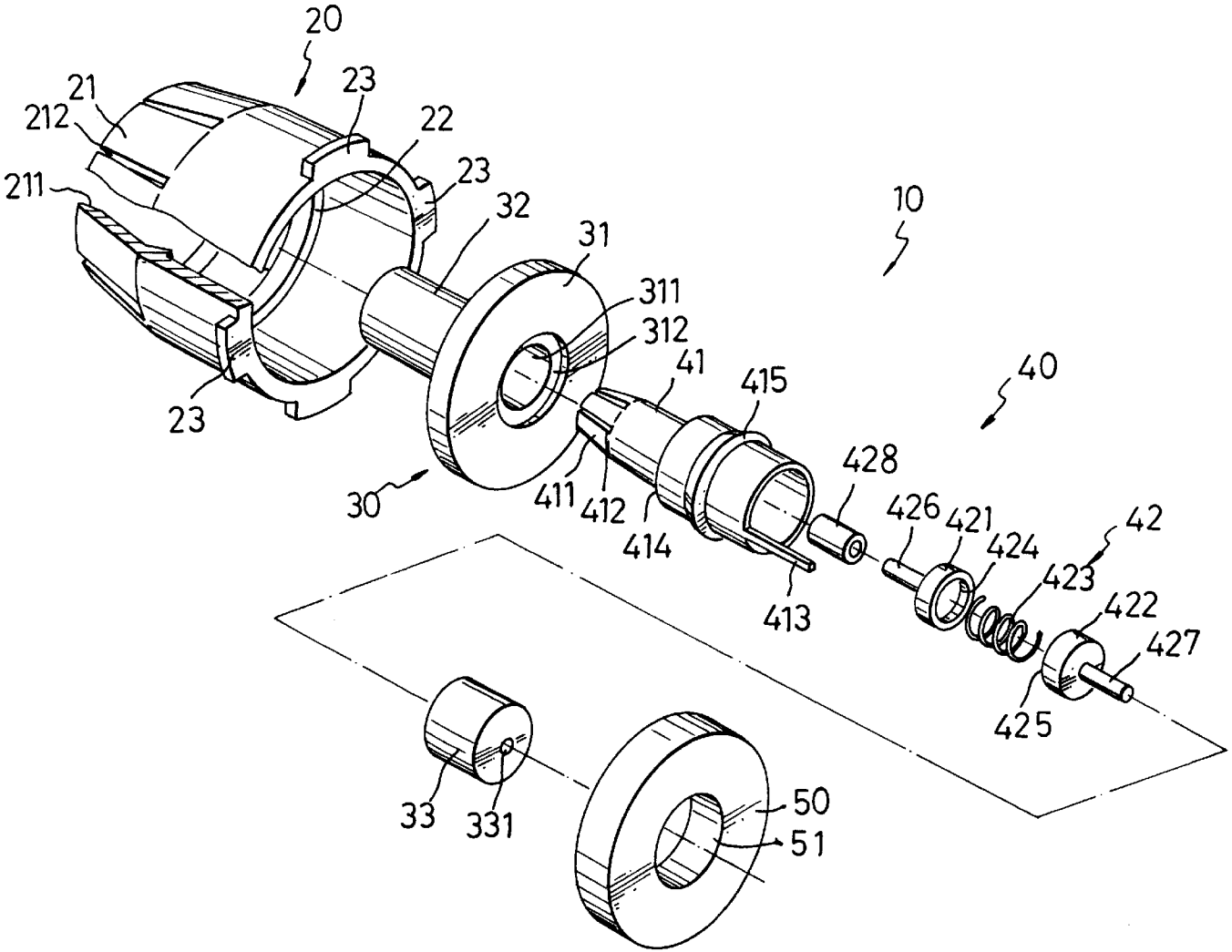
FIG. 4 is an exploded view of a coaxial cable connector according to an alternate form of the present invention.
Figure 6:
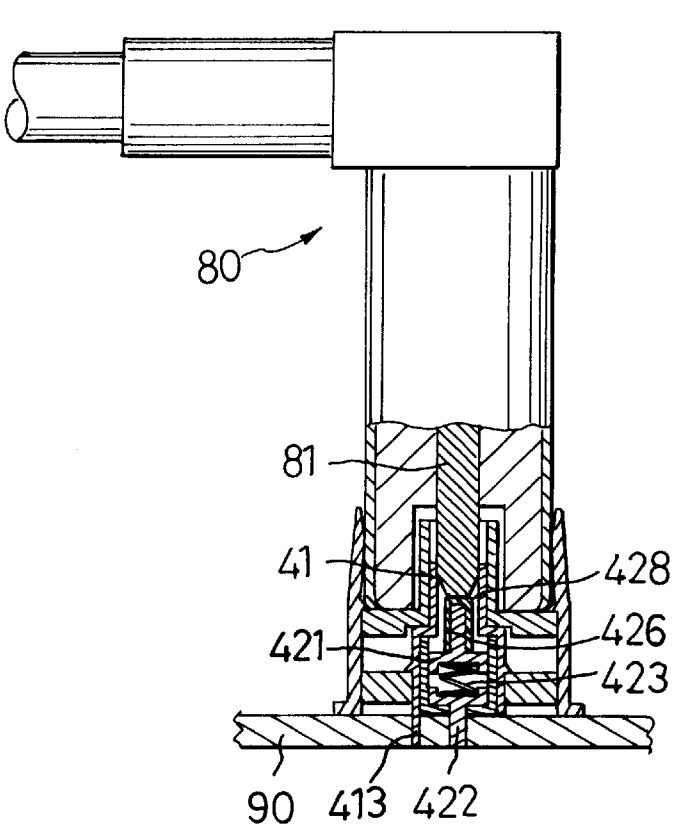
FIG. 6 is similar to FIG. 5 but showing the matching coaxial cable connector connected to the coaxial cable connector of the embodiment shown in FIG. 4, the second signal path electrically connected.
Figure 5:
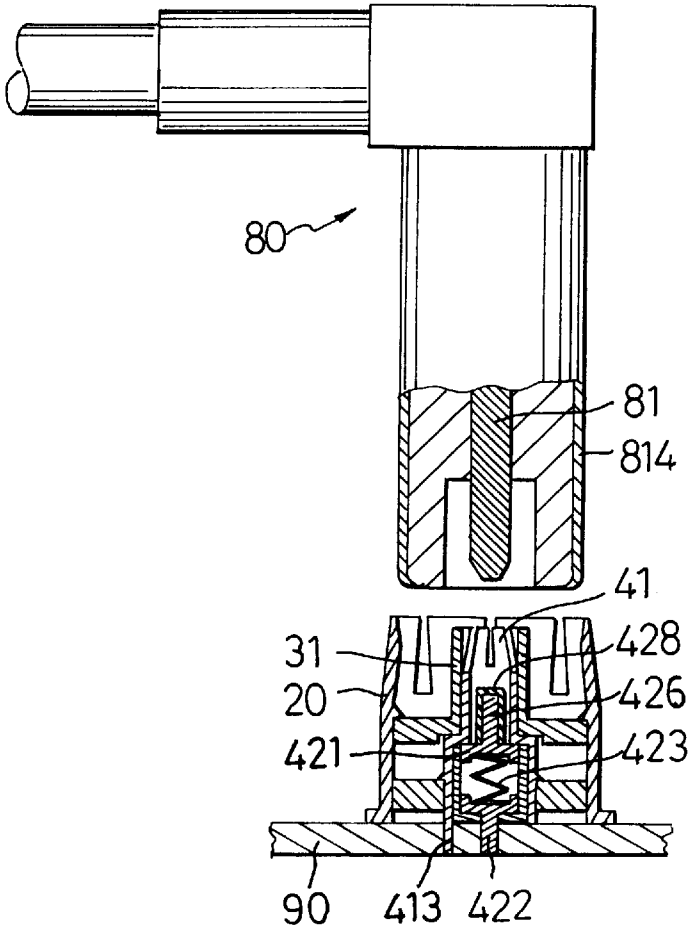
FIG. 5 illustrates the relationship between the coaxial cable connector of the embodiment shown in FIG. 4 and the matching coaxial cable connector, the coaxial cable connector of the embodiment shown in FIG. 4 installed in the PC board, the first signal path electrically connected.

Referring to FIGS. 2 and 3 again, the matching coaxial cable connector 80 comprises a metal casing 814, and a signal terminal 81 mounted in the metal casing 814. The signal terminal 81 comprises a tubular side terminal element 811, a cylindrical center terminal element 812 mounted in and projected out of the tubular side terminal element 811, and an insulator 813 which isolates the side terminal element 811 from the center terminal element 812. The side terminal element 811 and the center terminal element 812 are respectively made of electrically conductive material.

Referring to FIG. 2 again, when the matching coaxial cable connector 80 is not installed in the coaxial cable connector 10 of the present invention, the first terminal element 421 of the second terminal 42 is forced forwards by the spring element 423 into contact with the first terminal 41, thereby causing the first terminal 41 and the second terminal 42 to form a first signal path for internal signal transmission.

Referring to FIG. 3 again, when the coaxial cable connector 10 of the present invention and the matching coaxial cable connector 80 are connected together, the first terminal element 421 is pushed backwardly away from the first terminal 41 by the center terminal element 812 to compress the spring element 423, thereby causing the first terminal 41 and the center terminal element 812 to form a second signal path, for enabling the matching coaxial cable connector 80 to transmit signal directly.

FIGS. from 4 through 6 show a coaxial cable connector according to a second embodiment of the present invention. According to this embodiment, the signal terminal 81 of the matching coaxial cable connector 80 is a solid member integrally made of electrically conductive material, and the coaxial cable connector 10 of the present invention comprises an insulator 428 mounted around the periphery of the cylindrical projection 426 of the front terminal element 421 of the second terminal 42.

Figure 7:
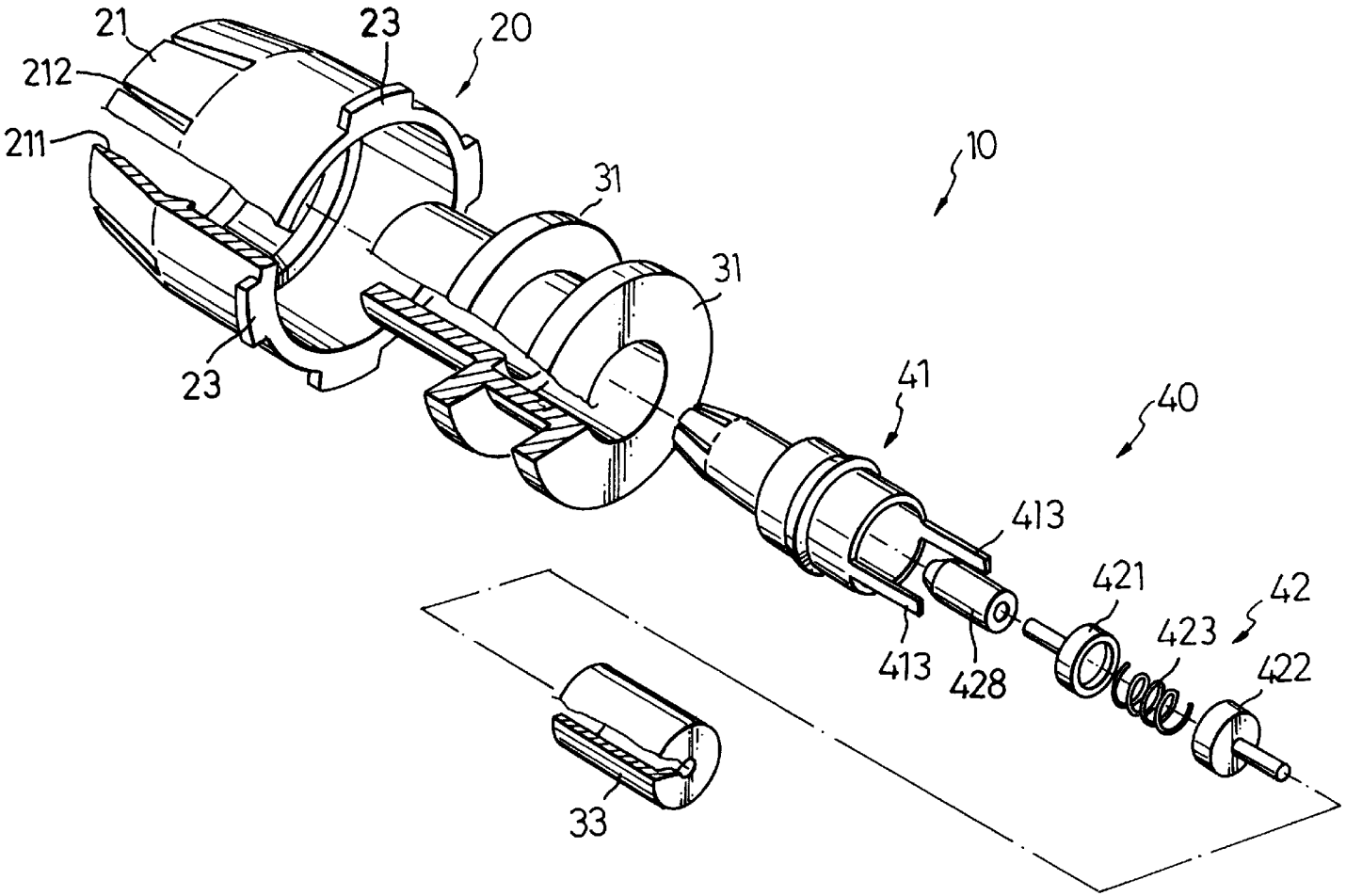
FIG. 7 is an exploded view of another alternate form of the present invention.
Figure 8:
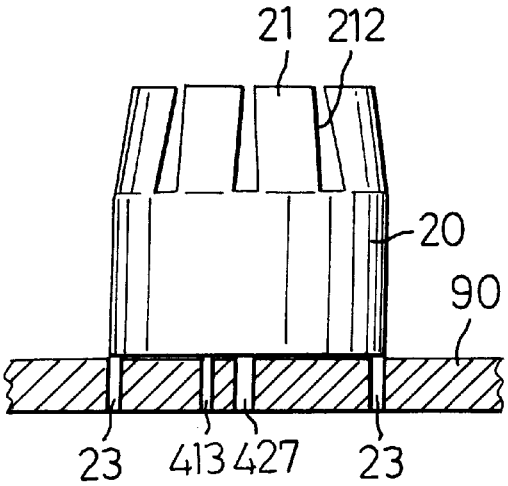
FIG. 8 is a sectional view of a part of another alternate form of the present invention, showing the mounting legs of the casing plugged into respective mounting holes at the PC board.
Figure 9:
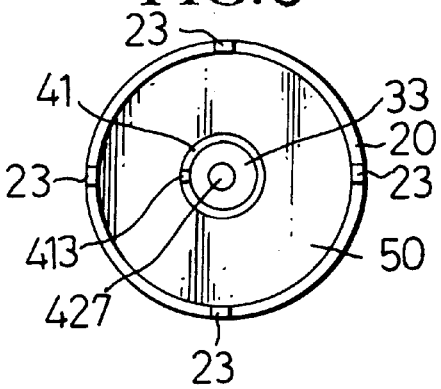
FIG. 9 is a bottom view of FIG. 8 (the PC board excluded).
Figure 10:
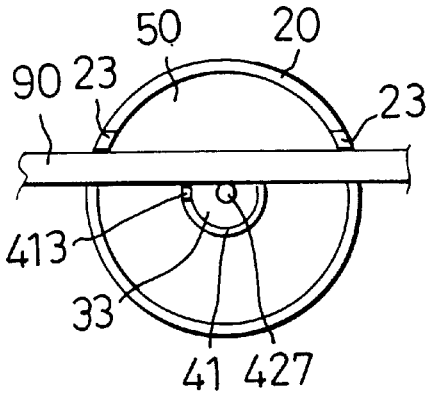
FIG. 10 is a rear side view showing the mounting legs and the signal terminal set clamped on the PC board according to the present invention.
Figure 11:
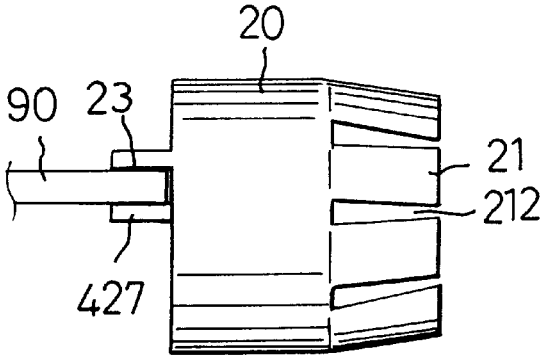
FIG. 11 is a side view of FIG. 10.

Referring to FIG. 7, the first insulator 31 of the insulator set 30 can be made in the shape shown in FIG. 7, i.e., the first insulator 31 shown in FIG. 7 is a combination of the first insulator 31 and positioning member 50 shown in FIG. 1. This alternate form eliminates the aforesaid positioning member 50, and the first insulator 31 can be directly positioned in the casing 20.

Referring to FIGS. from 8 through 11, the mounting legs 23 may be longitudinally extended from the rear end of the casing 20 for plugging into respective mounting holes at the PC board 90, or fastening with the signal terminal set 40 to the casing 20 by clamping.

Figure 12:
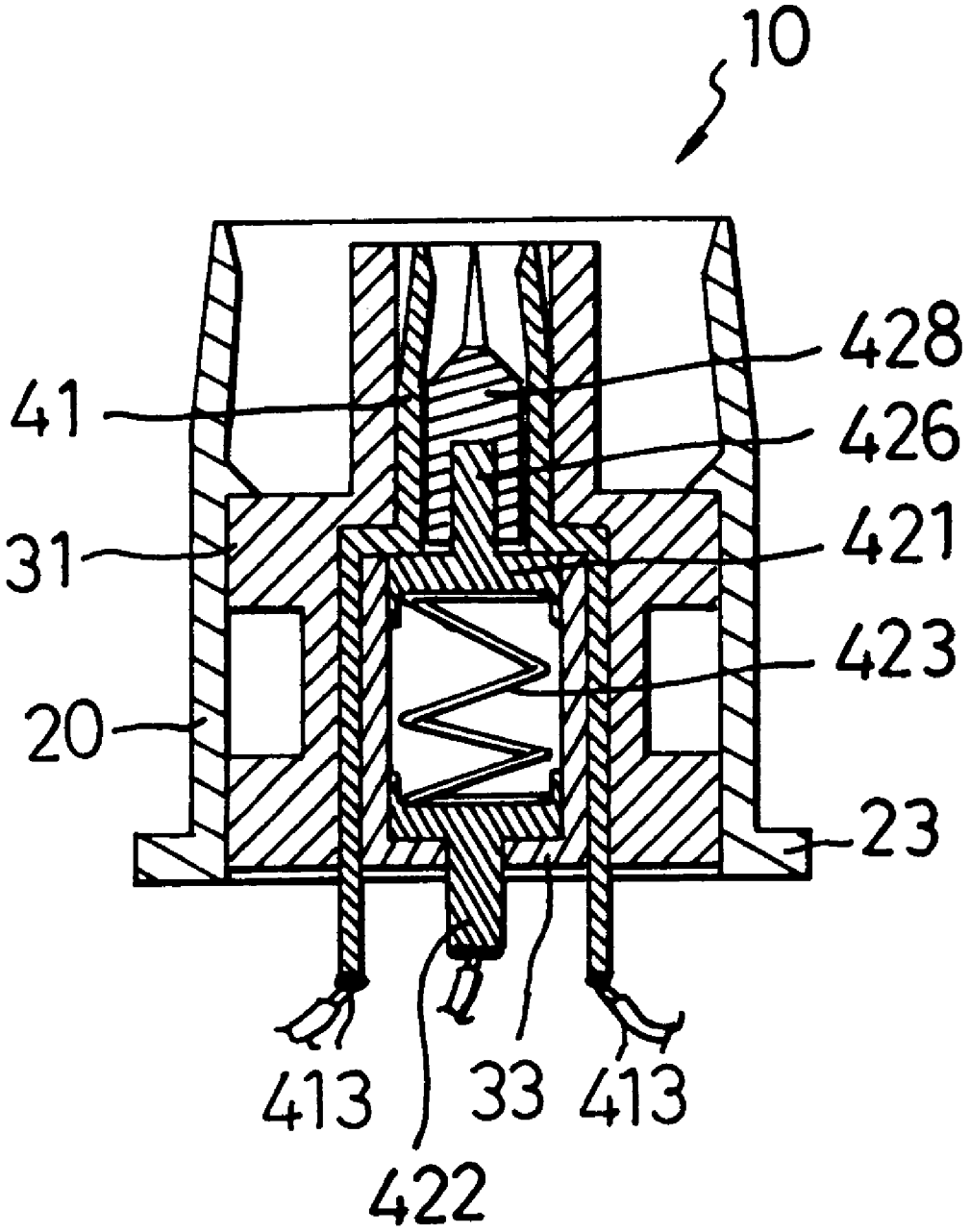
FIG. 12 is a sectional view of still another alternate form of the present invention, showing the legs backwardly extended from the rear end of the first terminal, electric wires respectively connected to the legs of the first terminal and the second terminal element of the second terminal according to the present invention.

In the alternate form shown in FIG. 12, the first terminal 41 is made having a plurality of backwardly extended legs 413, and the legs 413 of the first terminal 41 and the second terminal element 422 of the second terminal 42 are respectively electrically connected to the PC board 90 by electric wires.

Figure 13:
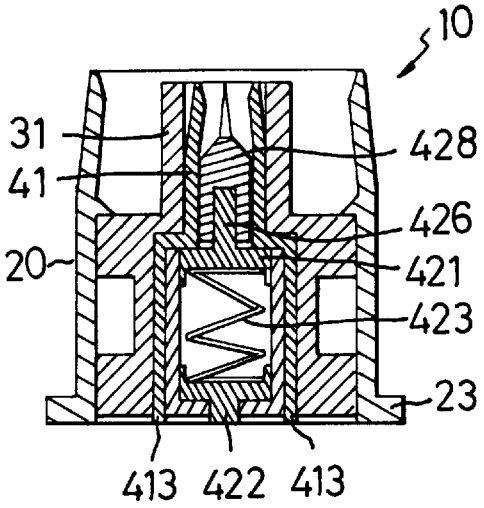
FIG. 13 is a sectional view of still another alternate form of the present invention where the legs of the first terminal and the second terminal element of the second terminal are designed for connection to the PC board by spot welding.

In the alternate form shown in FIG. 13, the legs 413 of the first terminal 41 and the second terminal element 422 of the second terminal 42 are designed for direct connection to the PC board 90 (not shown) by spot welding.

Figure 14:
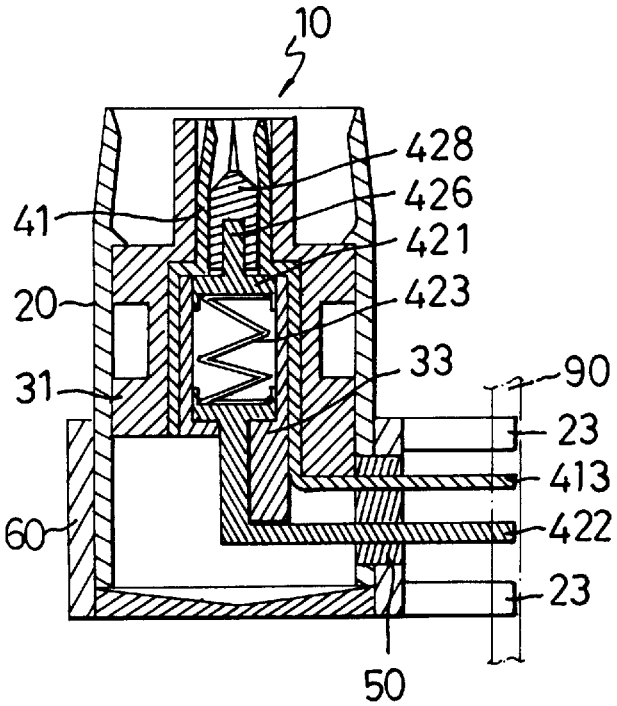
FIG. 14 is a sectional view of still another alternate form of the present invention, showing a coupling connected between the coaxial cable connector and the PC board according to the present invention.
Figure 15:
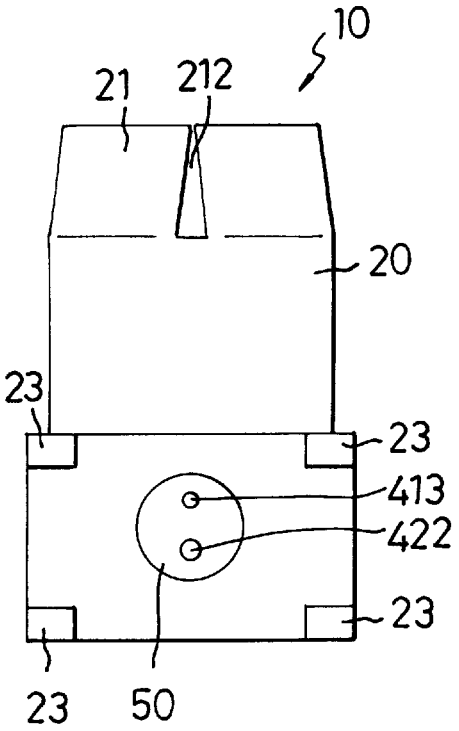
FIG. 15 is a front view of FIG. 14.

In the alternate form shown in FIG. 14 and 15, the coaxial cable connector 10 is coupled to the PC board 90 by a coupling 60.

Figure 16:
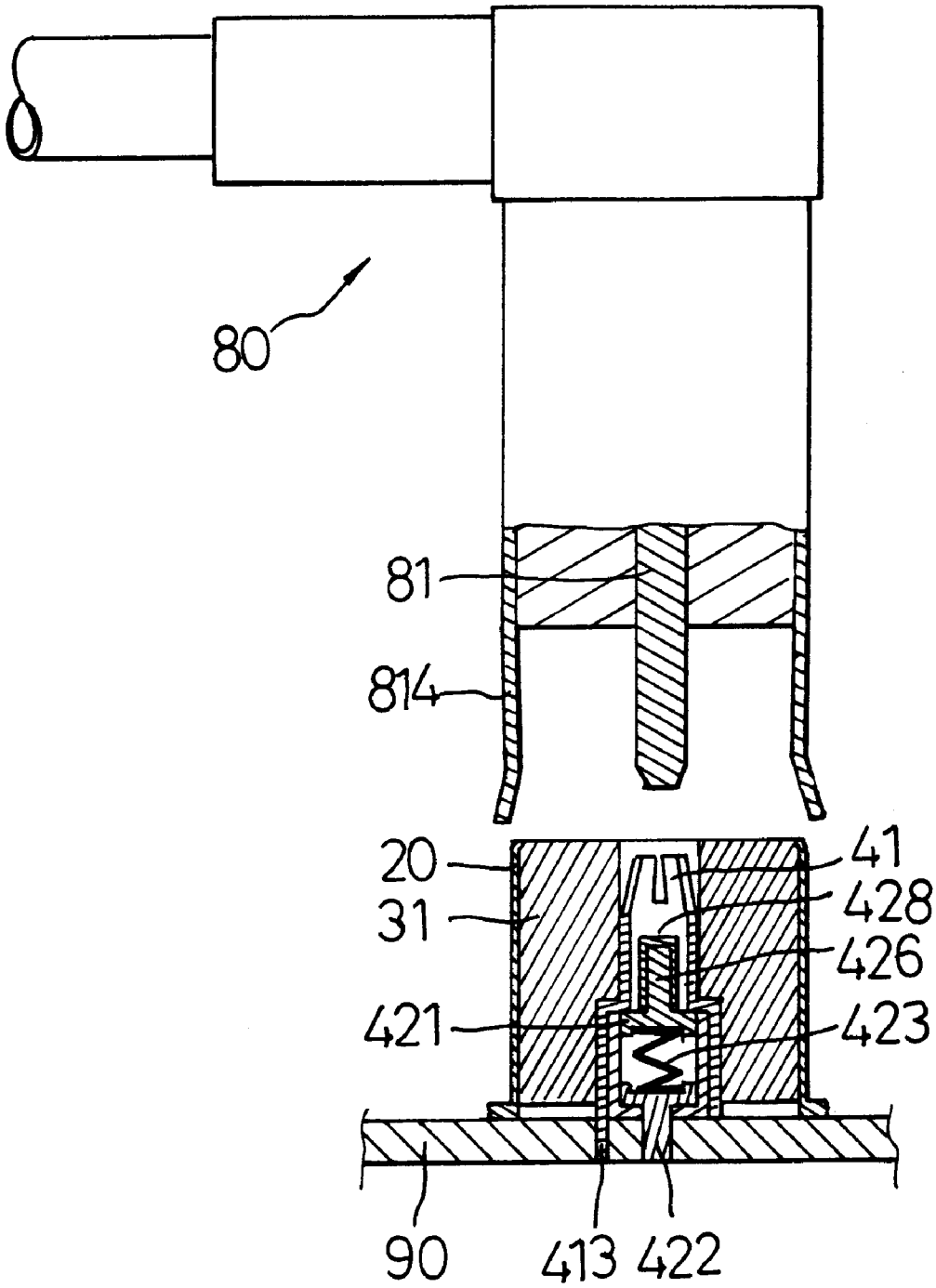
FIG. 16 illustrates the operation of a third preferred embodiment of the present invention.

FIG. 16 schematically illustrates the operation of a third preferred embodiment of the present invention. The structure of this preferred embodiment is similar to that of the second embodiment. The difference is that the clamping strips 21 of the casing 20 and the metal casing 814 of the coaxial cable connector 80 of the second embodiment are replaced with each other.

What the invention claimed is:

1. A coaxial cable connector for mounting on a printed circuit board to receive a matching coaxial cable connector, comprising:

a casing, said casing being a hollow cylindrical metal shell comprising a plurality of clamping strips and longitudinal slots alternatively arranged at a front side thereof for holding down the matching coaxial cable connector, at least one stop flange raised from an inside wall thereof, and a plurality of mounting legs at a rear side thereof for fastening to the printed circuit board;

an insulator set mounted inside said casing, said insulator set comprising a first insulator and a second insulator, said first insulator being mounted within said casing and supported on said at least one stop flange, said first insulator comprising a center hole, said second insulator being a hollow cylindrical member having a center hole at the center of a bottom side thereof; and a signal terminal set mounted inside said casing and insulated from said casing by said insulator set, said signal terminal set comprised of a first terminal and a second terminal, said first terminal and said second terminal being respectively made of electrically conductive material, said first terminal being a stepped, hollow cylindrical member mounted in the center hole of said first insulator for receiving the signal terminal of the matching coaxial cable connector, said second terminal being mounted inside said fist terminal and insulated from said first terminal by said second insulator, said second terminal comprised of a front terminal element, a rear terminal element, and a metal spring element connected between said front terminal element and said rear terminal element;

wherein when the matching coaxial cable connector is installed in said casing, said second terminal element is forced backwards by the matching coaxial cable connector and electrically disconnected from said first terminal, and said first terminal being electrically connected to the signal terminal of the matching coaxial cable connector for external signal transmission; when the matching coaxial cable connector is disconnected from said casing, said second terminal element is forced forwards by said spring element into contact with said first terminal for internal signal transmission.

2. The coaxial cable connector of claim 1 wherein said first insulator comprises a tubular extension raised from a front side thereof around the center hole at said first insulator.

3. The coaxial cable connector of claim 2 wherein said first insulator further comprises an annular groove formed at a back side thereof around the center hole at said first insulator.

4. The coaxial cable connector of claim 3 wherein said first terminal comprises a shoulder stopped at the annular groove at said first insulator.

5. The coaxial cable connector of claim 1 wherein the first terminal clement of said second terminal is peripherally covered with insulator means.

6. The coaxial cable connector of claim 1 further comprising a positioning member mounted in said casing around said first terminal to hold down said signal terminal in said casing.

7. The coaxial cable connector of claim 6 wherein said positioning member is formed integral with said first insulator.

* * * * *